US010711545B2

(12) United States Patent
Babri et al.

(10) Patent No.: US 10,711,545 B2
(45) Date of Patent: Jul. 14, 2020

(54) SHALE SHAKER WITH STAIR-STEPPED ARRANGEMENTS OF SCREENS AND METHODS OF USING SAME, AND METHODS OF RETROFITTING SHALE SHAKERS

(71) Applicant: Elgin Separation Solutions Industrials, LLC, Stafford, TX (US)

(72) Inventors: Emad Babri, Katy, TX (US); Michael Rai Anderson, Houston, TX (US)

(73) Assignee: Elgin Separation Solutions Industrials, LLC, Stafford, TX (US)

( * ) Notice: Subject to any disclaimer, the term of this patent is extended or adjusted under 35 U.S.C. 154(b) by 701 days.

(21) Appl. No.: 14/702,738

(22) Filed: May 3, 2015

(65) Prior Publication Data

US 2016/0319616 A1 Nov. 3, 2016

(51) Int. Cl.
*E21B 21/06* (2006.01)

(52) U.S. Cl.
CPC ..... *E21B 21/066* (2013.01)

(58) Field of Classification Search
None
See application file for complete search history.

(56) References Cited

U.S. PATENT DOCUMENTS 2,095,504 A * 10/1937 Kesti ..... A01K 69/00 210/160
2,329,333 A * 9/1943 Carter ..... B01D 35/28 210/389
3,568,839 A * 3/1971 Dunlea ..... B03B 5/28 210/194
4,306,974 A * 12/1981 Harry ..... B01D 35/28 210/388
4,582,597 A * 4/1986 Huber ..... B07B 1/48 209/313
5,392,925 A 2/1995 Seyffert
5,429,247 A * 7/1995 Lemay ..... B07B 1/00 209/17
5,530,482 A * 6/1996 Gove ..... H04N 5/74 348/441
5,593,582 A 1/1997 Roff
5,615,776 A * 4/1997 Bjorklund ..... B07B 1/4645 209/403
5,641,070 A 6/1997 Seyffert
(Continued)

FOREIGN PATENT DOCUMENTS

CN 101523013 A 9/2009
WO 01/97947 A1 12/2001
(Continued)

OTHER PUBLICATIONS

International Search Report and Written Opinion of the ISA/US dated Aug. 16, 2016 in PCT/US2016/030606; 8pgs.

*Primary Examiner* — Robert J Popovics
(74) *Attorney, Agent, or Firm* — Fredrikson & Byron, P.A.

(57) ABSTRACT

A shale shaker that includes a base, a basket, a vibrator interconnected with the basket, and two shaker screens releasably mounted on the basket, with the first shaker screen having a discharge end, with the second screen having a first end with a seal abutted thereto, with the second screen positioned such that the seal is positioned below the first shaker screen, and positioned so that discharge from the first screen will not discharge onto the seal.

10 Claims, 2 Drawing Sheets

(56) References Cited

U.S. PATENT DOCUMENTS 5,944,034 A * 8/1999 McRae ..... B09B 3/0058 110/236
6,070,736 A * 6/2000 Ballman ..... B07B 1/46 209/325
6,269,954 B1 * 8/2001 Baltzer ..... B01D 33/0376 209/309
6,273,270 B1 * 8/2001 Nakamura ..... B01D 29/093 210/386
6,443,310 B1 9/2002 Schulte et al.
6,530,482 B1 3/2003 Wiseman
6,662,952 B2 12/2003 Adams et al.
6,769,550 B2 8/2004 Adams et al.
6,863,183 B2 3/2005 Schulte et al.
6,868,972 B2 3/2005 Seyffert et al.
6,955,262 B2 * 10/2005 Seyffert ..... B01D 33/0376 209/405
7,040,488 B2 * 5/2006 Seyffert ..... B01D 33/0376 209/405
7,122,119 B2 * 10/2006 Gribble ..... B01D 29/05 210/232
7,389,882 B2 * 6/2008 Cady ..... B07B 1/06 209/405
7,571,817 B2 8/2009 Scott et al.
7,581,647 B2 9/2009 Grichar et al.
8,261,915 B2 * 9/2012 Bailey ..... B07B 1/46 209/405
8,556,083 B2 10/2013 Burnett
8,557,127 B2 * 10/2013 Houle ..... B07B 1/04 119/451
8,562,832 B2 * 10/2013 Houle ..... B01D 33/0361 209/17
8,869,986 B2 10/2014 Bailey
9,149,839 B2 * 10/2015 Carr ..... B07B 1/46
2003/0127375 A1 * 7/2003 Gribble ..... B01D 29/05 210/101
2004/0149632 A1 * 8/2004 Schulte, Jr. ..... B01D 33/0376 209/405
2004/0245153 A1 * 12/2004 Seyffert ..... B01D 33/0376 209/372
2005/0035033 A1 2/2005 Adams et al.
2005/0183994 A1 8/2005 Hensley et al.
2008/0078701 A1 4/2008 Carr et al.
2010/0270216 A1 10/2010 Burnett et al.
2013/0105369 A1 * 5/2013 Houle ..... B07B 1/04 209/240
2013/0105409 A1 * 5/2013 Houle ..... B01D 33/0361 210/770
2014/0021120 A1 1/2014 Burnett
2016/0319616 A1 * 11/2016 Babri ..... E21B 21/066

FOREIGN PATENT DOCUMENTS

WO 2004035233 A1 4/2004
WO 2016179192 A1 11/2016

* cited by examiner

SHALE SHAKER WITH STAIR-STEPPED ARRANGEMENTS OF SCREENS AND METHODS OF USING SAME, AND METHODS OF RETROFITTING SHALE SHAKERS

RELATED APPLICATION DATA

Not applicable.

BACKGROUND OF THE INVENTION

1. Field of the Invention

The present invention relates to methods of and apparatus for the processing of drilling fluids. In another aspect, the present invention relates to drilling fluid processing apparatus and methods for processing drilling fluids. In even another aspect, the present invention relates to shale shakers for processing drilling fluids, and to methods of processing drilling fluids with shale shakers. In still another aspect, the present invention relates to shale shakers having a stair-stepped (or cascade) shaker screen deck arrangement, and to methods of processing drilling fluids using such shale shakers, and to methods of retrofitting shale shakers. In yet another aspect, the present invention relates to shale shakers having a stair-stepped shaker screen deck arrangement arranged in a manner that will protect the seals from the direct flow of fluids/solids, and to methods of processing drilling fluids using such shale shakers.

2. Brief Description of the Related Art

In the drilling of a borehole in the construction of an oil or gas well, a drill bit is arranged on the end of a drill string, which is rotated to bore the borehole through a formation. A drilling fluid known as "drilling mud" is pumped through the drill string to the drill bit to lubricate the drill bit. The drilling mud is also used to carry the cuttings produced by the drill bit and other solids to the surface through an annulus formed between the drill string and the borehole. The density of the drilling mud is closely controlled to inhibit the borehole from collapse and to ensure that drilling is carried out optimally. The density of the drilling mud affects the rate of penetration of the drill bit. By adjusting the density of the drilling mud, the rate of penetration changes at the possible detriment of collapsing the borehole. The drilling mud may also carry lost circulation materials for sealing porous sections of the borehole. The acidity of the drilling mud may also be adjusted according to the type of formation strata being drilled through. The drilling mud contains inter alia expensive synthetic oil-based lubricants and it is normal therefore to recover and re-use the used drilling mud, but this requires inter alia the solids to be removed from the drilling mud. This is achieved by processing the drilling mud.

This need for solids control in drilling mud in hydrocarbon well drilling is well known in the prior art. Generally, at the top of the well, the solids-laden mud is introduced to a shale shaker, a device which typically has a series of screens arranged in tiered or flat disposition with respect to each other. The screens catch and remove solids from the mud as the mud passes through them. If drilled solids are not removed from the mud used during the drilling operation, recirculation of the drilled solids can create viscosity and gel problems in the mud, as well as increasing wear in mud pumps and other mechanical equipment used for drilling. In some shale shakers a fine screen cloth is used with the vibrating screen. The screen may have two or more overlying layers of screen cloth. The frame of the vibrating screen is resiliently suspended or mounted upon a support and is caused to vibrate by a vibrating mechanism, e.g. an unbalanced weight on a rotating shaft connected to the frame. Each screen may be vibrated by vibratory equipment to create a flow of trapped solids in either direction on top surfaces of the screen for removal and disposal of solids. The fineness or coarseness of the mesh of a screen may vary depending upon mud flow rate and the size of the solids to be removed.

Certain prior art screens have sealing members along opposed sides of the screens to seal downwardly against or upwardly against a mounting surface, e.g. a screen mounting member such as a "C" shaped channel. In other prior art devices, the screens are pressed against seals which are disposed on and/or secured to the mounting apparatus; in one device this is done on four sides of a rectangular screen.

A particular problem is encountered when two or more screens are abutted together in a linear arrangement to form a deck of screens. Vibration is introduced to urge the flow of solids containing fluids across the deck one screen at a time. While there certainly are seals between the abutted screens, as the particles traverse between the screens and over the seal abutted there between, a certain amount of particles is retained in the small recesses between the seal and the screens. The extreme vibrating environment causes all sorts of movement of the screen, seals and particles relative to each other. Over time, in this vibrating environment, the particles will work their way past the seals, even if the seal is intact and properly seated. In addition, between the corrosive action of the vibrating particles against the seals abrading the seals, and the harsh effect of the oil based fluids eating away on the seals, the integrity of the seal is slowly compromised.

In addition to a linear multi-screen deck arrangement, there is also a prior art stair-stepped (or cascade) deck in which the screens are stair stepped. In such a stair-step arrangement, an upstream desk discharges onto a subsequent screen that is positioned to receive the discharge. However, the configuration generally provides the discharge directly onto the seal positioned on the end of the subsequent screen. This too results in a certain amount of particles by-passing the seals and falling through.

There are a number of patents and publications which relate to shale shakers.

U.S. Pat. No. 5,392,925 issued to Seyffert on Feb. 28, 1995, discloses a vibratable shale shaker screen is disclosed which in one aspect, has a frame, screening material secured over the frame, and one or more sealing members secured to the frame for sealingly contacting an adjacent frame and/or adjacent portions of the frame or of screen mounting apparatus such as mount channels on the frame. Alternatively, sealing elements are provided on screen mounting apparatus, e.g. channels, on a shale shaker. A shale shaker is disclosed with at least one such screen. In one aspect such a shale shaker has three such screens disposed in a tiered configuration, one screen in sealing contact with the next. Adjustable screen mounts are disclosed for releasably holding the screens in sealing contact with each other and with screen mounting apparatus.

U.S. Pat. No. 5,593,582 issued to Roff, Jr. on Jan. 14, 1997, discloses a shale shaker having two feeds, two screens, two mud outlets and a removable tray between the screens is disclosed. Each screen receives one feed and produces one outlet of cuttings and another outlet for separated mud for either bypass or direct feed to the mud tank or the other screen. The removable tray or trays facilitate the two screens acting in cascade. Valves are provided to control the overall flow rate to the shaker and to the lower level screen.

U.S. Pat. No. 5,641,070 issued to Seyffert on Jun. 24, 1997, discloses a shale shaker which, in one aspect, has one or more upper screens and one or more lower screens with an upper screen at a discharge end of the shale shaker and a lower screen disposed to receive material discharged from a discharge end of one of the upper screens. In one aspect a portion of a lower screen underlies the discharge end of the upper screen. In another aspect a solid flowback pan prevents material falling through the upper screen(s) from falling onto the lower screen(s); and, in another aspect, the pan prevents material on a top of the lower screen(s) from falling into a bottom sump of the shale shaker which receives material which has fallen through the screen(s).

U.S. Pat. No. 6,530,482 issued to Wiseman on Mar. 11, 2003, discloses tandem shale shaker having at least a base, at least one upper shaker screen, at least one lower shaker screen, a basket, an apparatus for vibrating the basket, at least one distribution conduit, a flowback pan, a flow director, and a distribution apparatus. The upper and lower shaker screens are releasably mounted on the basket. The at least one lower shaker screen is mounted at a level below the level of the at least one upper shaker screen and underlies the at least one upper shaker screen. The flowback pan is disposed between the at least one upper shaker screen and the at least one lower shaker screen and overlies at least a portion of the at least one lower shaker screen. The flowback pan directs the screened material passing through the at least one upper shaker screen to the at least one distribution conduit. The flow director selectively directs screened material flowing through the at least one distribution conduit (a) to the at least one lower shaker screen or (b) away from the at least one lower shaker screen. To operate the tandem shale shaker in parallel rather than in series, the distribution apparatus is set to selectively directs unscreened material to the at least one lower shaker screen. Further, the flow director directs the screened material from the at least one upper shaker screen away from the at least one lower shaker screen.

U.S. Pat. No. 6,662,952 issued to Adams on Dec. 16, 2003, discloses screen support for supporting screening material of a screen assembly for use on a shale shaker for separating components of material introduced thereto, the screen support having a body, a plurality of spaced apart holes through the body, each of said holes for receiving part of a fastener used for releasably connecting the screen assembly to a shale shaker; the screen support in certain aspects being a frame, a perforated plate, a strip support or a unibody structure; a screen assembly with such a support; such a screen assembly, in certain aspects, with a plastic grid or layer with corresponding fastener holes; a shale shaker with any such screen assembly; and methods of their use.

U.S. Pat. No. 6,769,550 issued to Adams on Aug. 3, 2004, discloses a shale shaker system for separating components of drilling fluid with solids entrained therein, the shale shaker system, in at least certain aspects, including a base, a screen mounting basket on the base, vibrating apparatus connected to the screen mounting basket for vibrating the screen mounting basket, the screen mounting basket having mounting structure for at least one screen assembly mounted on the mounting structure, the mounting structure having a body over which the at least one screen assembly is positionable, some components of the drilling fluid to be treated by the shale shaker flowable through the at least one screen assembly and through the body, at least one wear strip attached to the mounting structure, the at least one wear strip having a wear strip body, at least one upwardly projecting member projecting upwardly from the wear strip body, the at least one screen assembly including a screen support with screening material and at least one hole in the support sized, configured, and located for receiving the at least one upwardly projecting member of the wear strip body of the mounting structure and the at least one upwardly projecting member sized, located and configured for receipt within the at least one hole.

U.S. Pat. No. 6,863,183 issued to Schulte on Mar. 8, 2005, discloses a shale shaker for separating material, said shale shaker comprising a basket for supporting a screen assembly and a collection receptacle, the basket comprising two side walls, an end wall and an opening in the bottom of said basket, said basket having means to support screen assemblies for substantially covering said opening characterized in that said basket further comprises separating means in or on any of said walls for separating material. Preferably, further comprising directing means for directing separated material therefrom into said collection receptacle. The invention also provides a method for separating material using the shale shaker of the invention, a basket of the shale shaker of the invention and screen assemblies used in the shale shaker of the invention.

U.S. Pat. No. 6,868,972 issued to Seyffert on Mar. 22, 2005 discloses a vibratory separator including basket apparatus for holding screening apparatus, at least one upper screen apparatus in the basket, the at least one upper screen apparatus having a fluid exit end, at least one lower screen apparatus in the basket below the at least one upper screen apparatus, fluid flowable from the at least one upper screen apparatus down onto the at least one lower screen apparatus, flow diffusion apparatus mounted below the fluid exit end of the at least one upper screen apparatus and above the at least one lower screen apparatus, so that fluid flowing down from the at least one upper screen apparatus flows onto the flow diffusion apparatus and is diffused thereby, and vibrator apparatus for vibrating the basket and the screen apparatus therein.

U.S. Patent Publication No. 20050183994 published by Hensley on Aug. 25, 2005, discloses an integrated, transportable cuttings treatment system includes a multi-part shale shaker, preferably formed of six screens vibrated by at least one electric vibrator, and preferably four such vibrators. Solids are screen from drilling mud flowing onto the screens, and directed into a trough wherein is located a screw conveyor or augur. A pressure differential is developed across the screens to increase the flow rate of drilling mud through the screens.

U.S. Pat. No. 7,571,817 issued to Scott on Aug. 11, 2009, discloses a vibratory separator (in one aspect, a shale shaker) and methods for using it, the separator in certain aspects having a base, a basket movably mounted on the base, screen apparatus on the basket, material flowing onto the screen apparatus for treatment, at least a portion of the screen apparatus not inclined downhill (e.g. said portion horizontal or uphill), electromagnetic vibratory apparatus connected to the basket for vibrating the basket and the screen apparatus, driving apparatus for driving the electromagnetic vibratory apparatus, and control apparatus (on-site and/or remote) for controlling the driving apparatus and the electromagnetic vibratory apparatus; the material, in one aspect, being drilling fluid material with solids therein.

U.S. Pat. No. 7,581,647 issued to Grichar on Sep. 1, 2009, discloses a shale shaker or vibratory separator which, in one aspect, has a base, vibration isolation apparatus on the base, a basket, mount apparatus for mounting the basket on the base, and at least one of the base, basket, and the mount apparatus made of, encased in, or coated with composite material which, in certain aspects, is all or part flexible composite material; and methods of using such separators and shakers.

U.S. Patent Application 20100270216 published by Burnett on Oct. 28, 2010, discloses a shale shaker for separating solids from solids laden drilling fluid is disclosed as having a basket with a scalping screen deck, at least one first screen deck and at least one second screen deck. The basket further may have a flow tray arranged between said scalping screen deck and at least one first screen deck, and a plurality of first ducts and a plurality of second ducts, the plurality of first ducts for directing solids laden drilling fluid to the at least one first screen deck. The second plurality of second ducts are for directing solids laden drilling fluid to said second screen deck.

U.S. Patent Publication No. 20140021120 published by Burnett on Jan. 23, 2014, and U.S. Pat. No. 8,556,083 to Burnett issued Oct. 15, 2013, both disclose shale shakers with selective series/parallel flow path conversion. Specifically, methods and systems are disclosed employing a shale shaker for processing a mixture of drilling fluid and solids with multiple screen assemblies and conversion apparatus for switching flow to the screen assemblies between series flow and parallel flow; and in one aspect, a screen or screens for screening lost circulation material.

U.S. Pat. No. 8,869,986 issued to Bailey on Oct. 28, 2014, discloses screening methods and apparatus, particularly, an apparatus for use in screening a liquid and solids mixture feed comprises a conduit, including a screening portion that is formed and arranged to divide a liquid and solids mixture feed flowing through the conduit. The feed is divided into a first, cleaned stream comprising liquid and solid particles of below a selected size limit, and a second, concentrated, stream comprising liquid, and particles above the selected size limit. The apparatus may be a stand-alone module, part of a system with other solids and liquids separating equipment or an integral part of a solids and liquid separator such as a shale shaker. Methods of using the apparatus are also described.

However, in spite of the above advancements, there exists a need in the art for improved shale shakers and improved methods of processing solids containing fluids.

There also exists a need in the art for improved shale shakers to reduce or eliminate solids by passing the seals between abutted shaker screens arranged in a deck.

There even also exists a need in the art for improved shale shakers to reduce or eliminate the exposure of the screen seals to the processed fluids and/or solids.

There still also exists a need in the art for improved shale shakers to reduce or eliminate the degradation of the screen seals in the operation of the shale shaker.

These and other needs in the art will become apparent to those of skill in the art upon review of this specification, including its drawings and claims.

SUMMARY OF THE INVENTION

It is an object of the present invention to provide for improved shale shakers and improved methods of processing solids containing fluids.

It is another object of the present invention to provide for improved shale shakers to reduce or eliminate solids by passing the seals between abutted shaker screens arranged in a deck.

It is even another object of the present invention to provide for improved shale shakers to reduce or eliminate the exposure of the screen seals to the processed fluids and/or solids.

It is still another object of the present invention to provide for improved shale shakers to reduce or eliminate the degradation of the screen seals in the operation of the shale shaker.

These and other objects of the present invention will become apparent to those of skill in the art upon review of this specification, including its drawings and claims.

According to one non-limiting embodiment of the present invention there is provided a shale shaker that may include a base, a basket, a vibrator interconnected with the basket, and two shaker screens releasably mounted on the basket, with the first shaker screen having a discharge end, with the second screen having a first end with a seal abutted thereto, with the second screen positioned such that the seal is positioned below the first shaker screen, and positioned so that discharge from the first screen will not discharge onto the seal. In further embodiments of this embodiment, the second shaker screen assembly further includes a screen and a frame surrounding the screen, with the seal abutted to the screen, and wherein the second screen assembly is positioned such that at least a portion of the discharge from the first assembly will discharge onto the frame of the second assembly.

According to another non-limiting embodiment of the present invention, there is provided a shale shaker that may include a base; a basket supported by the base; a vibrator interconnected with the basket; and, N number of shaker screen assemblies releasably mounted to the basket. N will generally be greater than 1 and may be 2, 3, 4, 5, 6, 7, 8, 9, 10, 15, 20 or more. I will range from 1 to (N−1), with the Ith shaker screen assembly having an Ith discharge end, with the (I+1)th shaker screen assembly having an (I+1)th receiving end with an (I+1)th seal abutted thereto, with the (I+1)th screen assembly positioned such that the (I+1)th seal is positioned below the Ith shaker screen assembly, and positioned so that discharge from the Ith screen assembly will not discharge onto the (I+1)th seal. In further embodiment of this embodiments, the shale shaker of claim 1, further including wherein the (I+1)th shaker screen assembly further includes an (I+1)th screen and an (I+1)th frame surrounding the (I+1)th screen, with the (I+1)th seal abutted to the screen, and wherein the (I+1)th screen assembly is positioned such that at least a portion of the discharge from the Ith first assembly will discharge onto the frame of the (I+1)th assembly.

According to even another non-limiting embodiment of the present invention, there is provided a shale shaker that may include: a base; a basket supporting the base; a vibrator interconnected with the basket; and first and second shaker screen assemblies releasably mounted on the basket, and a substrate. The first shaker screen assembly will have a discharge end, with the second screen assembly having a first end with a seal abutted thereto. The substrate will define a channel, with the second screen assembly positioned such that the seal is positioned within the channel, and with the substrate positioned such that the channel is positioned below the first shaker screen to also position the seal below the first shaker screen assembly so that discharge from the first screen assembly will not discharge onto the seal. In further embodiments of this embodiment, the second shaker screen assembly further includes a screen and a frame surrounding the screen, with the seal abutted to the screen, and wherein the substrate is positioned to so that with the seal positioned within the channel, the second screen assembly is positioned such that at least a portion of the discharge from the first assembly will discharge onto the frame of the second assembly.

According to still another non-limiting embodiment of the present invention, there is provided a shale shaker that may include: a base; a basket supported by the base; a vibrator interconnected with the basket; and, first and second shaker screen assemblies releasably mounted to the basket; and a discharge shield. The first shaker screen assembly has a first discharge end, with the second shaker screen assembly having a receiving end with a seal abutted thereto. The discharge shield is positioned over the seal, with the second screen assembly positioned such that discharge from the first screen assembly will discharge onto the discharge shield positioned over the seal. In further embodiments of this embodiment, the second shaker screen assembly further includes a screen and a frame surrounding the screen, with the seal abutted to the screen, and wherein the second screen assembly is positioned such that at least a portion of the discharge from the first assembly will discharge onto the discharge shield and then onto the frame of the second assembly.

In yet another non-limiting embodiment of the present invention, there is provided a method of operating a shale shaker. The shale shaker may include: a base; a basket supported by the base; a vibrator interconnected with the basket; and, first and second shaker screen assemblies releasably mounted to the basket, with the first shaker screen assembly having a first discharge end, with the second shaker screen assembly having a receiving end with a seal abutted thereto, with the second screen assembly positioned such that the seal is positioned below the first shaker screen assembly. The method comprises discharging a material from the first assembly and onto the second assembly in a manner to avoid discharging the material onto the seal. In further embodiments of the present invention, the second shaker screen assembly further includes a screen and a frame surrounding the screen, with the seal abutted to the screen, wherein the discharging comprises discharging material from the first screen assembly such that at least a portion of the discharging material from the first assembly will discharge onto the frame of the second assembly.

According to even still another non-limiting embodiment of the present invention, there is provide a method of operating a shale shaker. The shale shaker may include: a base; a basket supported by the base; a vibrator interconnected with the basket; and, N number of shaker screen assemblies releasably mounted to the basket, with N being greater than 1, and an I ranging from 1 to (N−1), with the Ith shaker screen assembly having an Ith discharge end, with the (I+1)th shaker screen assembly having an (I+1)th receiving end with an (I+1)th seal abutted thereto, with the (I+1)th screen assembly positioned such that the (I+1)th seal is positioned below the Ith shaker screen assembly. The method may include discharging material from the Ith screen assembly and onto the (I+1)th assembly in a manner to avoid discharging the material onto the (I+1)th seal. In further embodiments of this embodiment, the (I+1)th shaker screen assembly further includes an (I+1)th screen and an (I+1)th frame surrounding the (I+1)th screen, with the (I+1)th seal abutted to the (I+1)th screen, wherein the discharging comprises discharging material from the Ith screen assembly such that at least a portion of the discharging material from the Ith assembly will discharge onto the frame of the (I+1)th assembly.

According to even yet another non-limiting embodiment of the present invention, there is provided a method of operating a shale shaker. The shale shaker may include: a base; a basket supporting the base; a vibrator interconnected with the basket; first and second shaker screen assemblies releasably mounted on the basket, with the first shaker screen assembly having a discharge end, with the second screen assembly having a first end with a seal abutted thereto; and a substrate defining a channel, with the second screen assembly positioned such that the seal is positioned within the channel, and with the substrate positioned such that the channel is positioned below the first shaker screen to also position the seal below the first shaker screen assembly. The method may include discharging from the first screen assembly onto the second screen assembly in such a manner to avoid discharging onto the seal. Further embodiments of this embodiment there is a screen and a frame surrounding the screen, with the seal abutted to the screen, and wherein the substrate is positioned to so that with the seal positioned within the channel, and the discharging comprises discharging such that at least a portion of the discharge from the first assembly will discharge onto the frame of the second assembly.

According to still even another non-limiting embodiment of the present invention, there is provided a method of operating a shale shaker. The shale shaker may include: a base; a basket supported by the base; a vibrator interconnected with the basket; and, first and second shaker screen assemblies releasably mounted to the basket, with the first shaker screen assembly having a first discharge end, with the second shaker screen assembly having a receiving end with a seal abutted thereto; and a discharge shield positioned over the seal. The method comprises, discharging material from the first screen assembly onto the second screen assembly such that the material will discharge onto the discharge shield positioned over the seal. In further embodiments of this embodiment, the second shaker screen assembly further includes a screen and a frame surrounding the screen, with the seal abutted to the screen. The discharging comprises discharging such that at least a portion of the discharge from the first assembly will discharge onto the discharge shield and then onto the frame of the second assembly.

It should be understood that the above embodiments are merely provided to illustrate the invention, and are to be considered non-limiting, and are not intended in any way to limit the scope of the claims. The above and other embodiments of the present invention, will become apparent to those of skill in the art upon review of this specification, including its drawings and claims. For example, for each shale shaker embodiment, there should be recognized further embodiments to any of the components of the shale shaker, including arrangements of the screens, screen assemblies, or deck of screen assemblies.

BRIEF DESCRIPTION OF THE DRAWINGS

The following drawings illustrate some of the many possible embodiments of this disclosure in order to provide a basic understanding of this disclosure. These drawings do not provide an extensive overview of all embodiments of this disclosure. These drawings are not intended to identify key or critical elements of the disclosure or to delineate or otherwise limit the scope of the claims. The following drawings merely present some concepts of the disclosure in a general form. Thus, for a detailed understanding of this disclosure, reference should be made to the following detailed description, taken in conjunction with the accompanying drawings, in which like elements have been given like numerals.

DETAILED DESCRIPTION OF THE INVENTION

Figure 1:
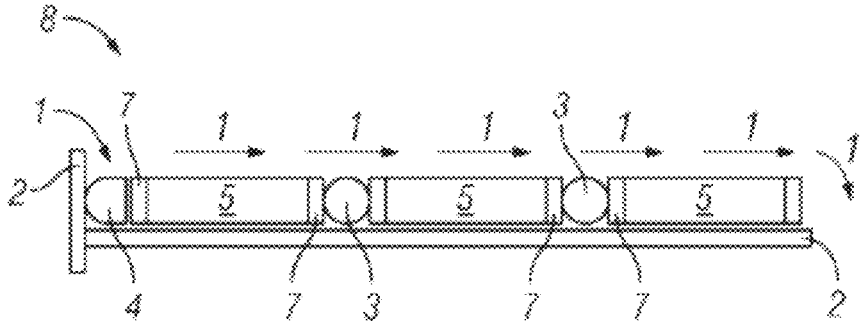
FIG. 1 (Prior Art)
FIG. 1 is a schematic representation of a common prior art linear multi-screen deck arrangement that is commonly utilized in shale shakers, showing deck 8 comprising screens 5 with seals 3 interposed there between, with each screen contained within a screen frame 7, all supported by support frame 2, and with processing flow represented by arrows 1.
Figure 2:
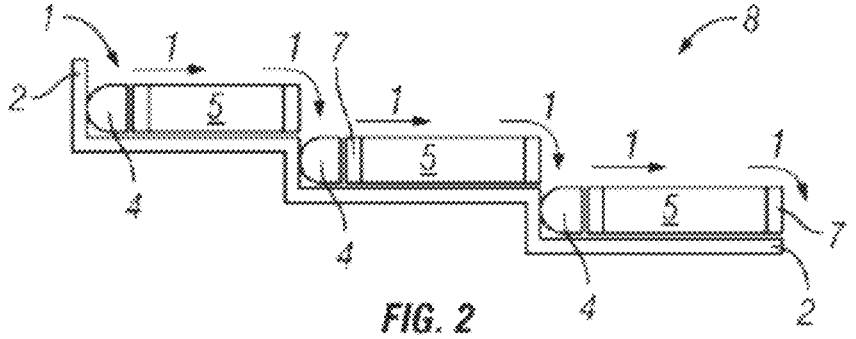
FIG. 2 (Prior Art)
FIG. 2 is a schematic representation of a common prior art stair-stepped (also known as cascade) multi-screen deck arrangement that is also commonly utilized in shale shakers, showing deck 8 comprising screens 5 with end seals 4, with each screen contained within a screen frame 7, all supported by support frame 2, and with processing flow represented by arrows 1.

Prior to a discussion of the present invention, and in order to better understand how the present invention is an improvement over the prior art, reference will first be made to FIGS. 1 and 2 showing two prior art multi-screen deck arrangements commonly utilized in prior art shale shakers.

Referring first to FIG. 1, there is shown a common prior art multi-screen linear deck arrangement that is commonly utilized in shale shakers, showing deck 8 comprising three screen assemblies. Each screen assembly generally includes a screen 5 and a screen frame 7 around the screen 5. There are seals 3 interposed there between the screen assemblies, all supported by support frame 2. Vibration is utilized to urge the flow of solids containing fluids across screens 5 one screen at a time as shown by arrows 1 representing the flow. It should be understood that at each screen and depending upon the rating of the screen, a certain amount of fluids/solids pass through the screen, with a certain amount moving on to the next screen. While there certainly are seals between the abutted screens, as the particles traverse between the screens and over the seal abutted there between, a certain amount of particles is retained in the small recesses between the seal and the screens. The extreme vibrating environment causes all sorts of movement of the screen, seals and particles relative to each other. Over time, in this vibrating environment, the particles will work their way past the seals, even if the seal is intact and properly seated. In addition, between the corrosive action of the vibrating particles against the seals abrading the seals, and the harsh effect of the oil based fluids eating away on the seals, the integrity of the seal is slowly compromised.

Referring additionally to FIG. 2, there is shown a common prior art stair-stepped (also known as cascade) multi-screen deck arrangement that is also commonly utilized in shale shakers, showing deck 8 comprising screen assemblies each having screens 5 with end seals 4, with each screen contained within a screen frame 7, all supported by support frame 2. A sealing arrangement is obtained by crushing end seals 4 against deck frame 2. Again, vibration is utilized to urge the flow of solids containing fluids across screens 5 one screen at a time as shown by arrows 1 representing the flow. It should be understood that at each screen and depending upon the rating of the screen, a certain amount of fluids/solids pass through the screen, with a certain amount moving on to the next screen. In such a stair-step arrangement, an upstream desk discharges onto a subsequent screen that is positioned to receive the discharge. Notice that this discharge is onto the seals 4, which will no doubt expose the seals to particles. As with the linear screen arrangement, the particles will work their way past the seals, even if the seal is intact and properly seated, and between the corrosive action of the vibrating particles against the seals abrading the seals, and the harsh effect of the oil based fluids eating away on the seals, the integrity of the seal is slowly compromised. This stair-stepped arrangement, however, presents an additional problem. Because the discharge is directly onto the seal positioned on the end of the subsequent screen, there is the additional abrasion of the seals caused by the gravitational dropping of the discharge onto the seals.

The present invention provides shale shaker screens, screen assemblies, arrangements of screens or screen assemblies, deck arrangements comprising screen assemblies or decks, and shale shakers, and methods of making and using any of the foregoing. The present invention will now be described with reference to FIGS. 3 and 4.

One non-limiting embodiment of the present invention provides a stair-stepped deck in which the screens of the deck are arranged in a manner that will protect the seals from the direct flow of fluids/solids. Another non-limiting embodiment of the present invention provides a stair-stepped arrangement in which shielding is provided to protect the seals form the direct flow of fluids/solids. Other non-limiting embodiments provide shale shakers that incorporate such screens, decks and arrangements, and methods of making and using the foregoing.

It is believed that either of these stair-stepped deck embodiments may be utilized to create a shale shaker, and certainly incorporated into any of the known prior art shale shakers, especially those utilizing multiple screens arranged in a deck, including but not limited to any of the shale shakers described in any prior art discussed in this specification. Thus, the present invention is also directed to shale shakers comprising a stair-stepped deck in which the seals are protected from the direct flow of fluids/solids. The present invention also is directed to methods of processing fluids/solids with such shale shakers. The present invention is also directed to methods of retrofitting the prior art shale shakers by replacing their screens and/or seals with the arrangements provided in the present invention.

Figure 3:
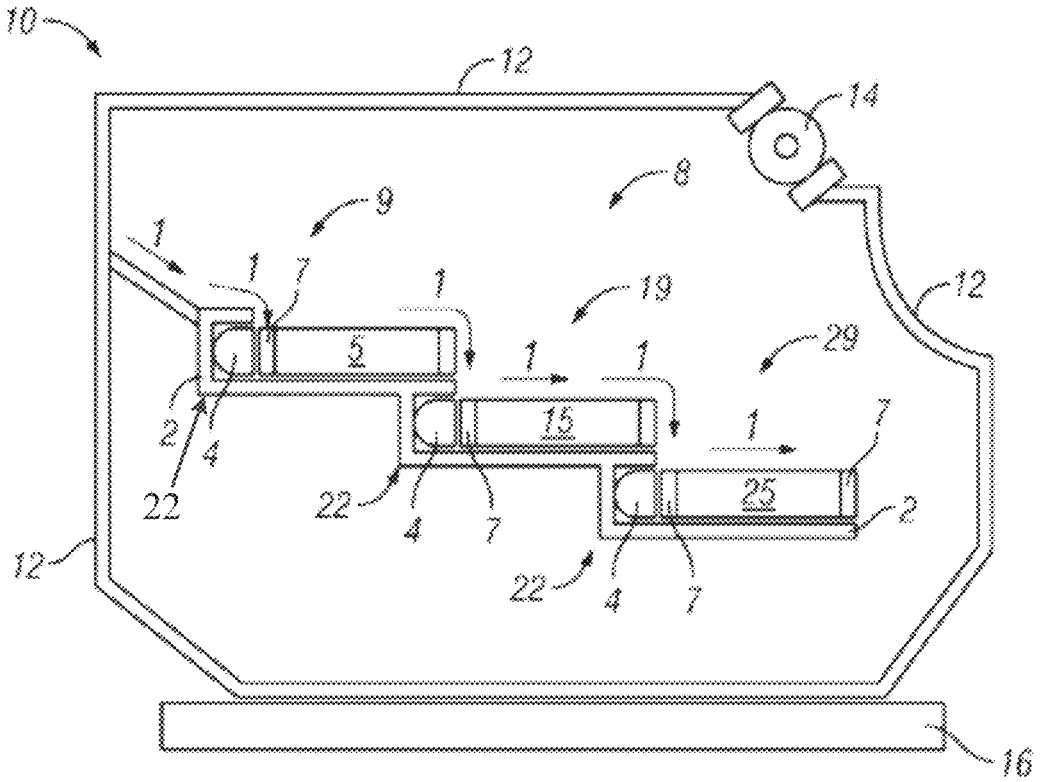
FIG. 3 is a schematic representation of one non-limiting embodiment of the present invention, showing shale shaker 10 having a stair-stepped deck 8 in which the screens 5, 15 and 25 of deck 8 are arranged in a manner that will protect the seals 3 from the direct flow of fluids/solids, and with processing flow represented by arrows 1.

Referring now to FIG. 3, there is shown a schematic representation of a shale shaker 10 having a stair-stepped deck 8 having screen assemblies 9, 19 and 29, each comprising a screen, screen frame and end seal on the end of the frame. As shown, screens 5, 15 and 25 of deck 8 are arranged in a manner that will protect screen end seals 4 from the direct flow of fluids/solids. Generally, each end seal 4 may be affixed/adhered to its corresponding screen. These screens 5, 15 and 25 are supported by deck frame 2 that is generally anchored/supported by basket 12. Deck frame 2 may include channel portions 22 into which screen end seals 4 are crushed by positioning of the screens. These screens are contained within a vibratable screen mounting apparatus or basket 12 as is well known in the art. Very commonly, these baskets will be supported by a basket support frame 16 which is also well known in the art. This basket 12 may be vibrated by a motor and interconnected vibrating apparatus 14 which is in contact with basket 12 for vibrating the basket and the screens. In the stair stepped arrangement as shown in FIG. 3, the second screen 15 is arranged such that the discharge end of the first screen 5 will discharge onto the second screen assembly 15 in such a manner as to avoid landing/discharging onto seal 4 of second screen 15, and downstream of the seal 4.

By "downstream" it is meant that such discharge will land on the next screen assembly with vibratory forces moving the discharge away from the seal, not on or toward the seal. That is, "downstream" is in reference to the direction of material flow, and "upstream" is in reference to against the direction of material flow, for which the apparatus is designed for, intended to operate, or is operating. Generally, this means that seal 4 of second screen assembly 19 is positioned beneath or underneath first screen assembly 9. It should be clear that discharge flowing off of first screen assembly 9 will fall onto second screen assembly 19 in a landing zone that is downstream of seal 4. Likewise, the third screen assembly 29 is arranged such that the discharge end of the second screen assembly 19 will discharge onto the third screen assembly 29 in such a manner as to avoid discharging onto seal 4 of third screen assembly 19, and downsteam of seal 4. Generally, this means that seal 4 of third screen assembly 29 is positioned beneath or underneath second screen assembly 19. While the embodiment of the present invention is shown in FIG. 2 as having three screen assemblies, it should be understood that other embodiments of the present invention are contemplated in which there may be 2 or more screen assemblies, and the arrangement of those screens will be as generally described herein, that is, the discharge of the preceding screen is discharged onto the next screen in a manner as to avoid discharge onto the seal and downstream of the seal.

The discharge of the flow from the previous screen assembly to the next screen assembly may be onto the frame portion 7 or screen portion of the screen assembly, as long as it is downstream from seal 4. It should be understood, however, that discharge onto the screen assembly may cause wear/abrasion of the screen because of the gravitational dropping of the discharge onto the screen, and while embodiments of the present invention certainly include such discharge onto the screen, other embodiments either minimize such or avoid it entirely. In the present invention, it is desired that the downstream screen assembly be positioned to receive at least a portion of, preferable more than a quarter of, most of, more preferable the vast majority of (i.e., more than 50 percent), even more preferable substantially all of (i.e., more than 75%), still more preferably essentially all of (i.e., more than 95%), and still more preferable all of (i.e., more than 99.9%), the discharge from the upstream screen assembly is onto the frame 7 of the downstream assembly (with the condition being considered obtained if obtained by weight percent or by volume percent of the discharged material).

It is understood that in many instances, some amount of discharged material may in advertently splash onto the seals. For example, even though the discharge may be "downstream", if the landing/discharge is close to the seal, there may be splashing (or even some upstream movement) of discharged material onto the seal. While such splashing/upsteam movement is certainly to be reduced/minimized/avoided to optimize operation, embodiments in which the discharge is downstream of the seal is still considered to be within the scope of the present invention, even if discharged material splashes or moves upstream onto the seal.

In operation, material to be shaken is introduced onto the first screen 5 in any manner as is well known in the art, very commonly from a deflector plate. The basket 12 may include components as are well known in the art, including but not limited to those components described in the prior art discussed in this specification.

The vibratory forces will urge the material to move across screen 5 and to be discharged onto screen assembly 19. Liquids and certain sized particles are passing through screen 5 as the material moves across screen 5. Upon being discharged onto screen assembly 19, the vibratory forces are urging this material to move away from seal 4 and across screen 15 to be discharged onto screen assembly 29, while liquids and certain sized particles are passing though screen 15 as the material moves across screen 15. Upon being discharged onto screen assembly 29, the vibratory forces are urging this material to move away from seal 4 and across screen 25 to be discharged from screen assembly 29 (to be collected apart from material that was passing through the screens), while liquids and certain sized particles are passing though screen 25 as the material moves across screen 25.

Figure 4:
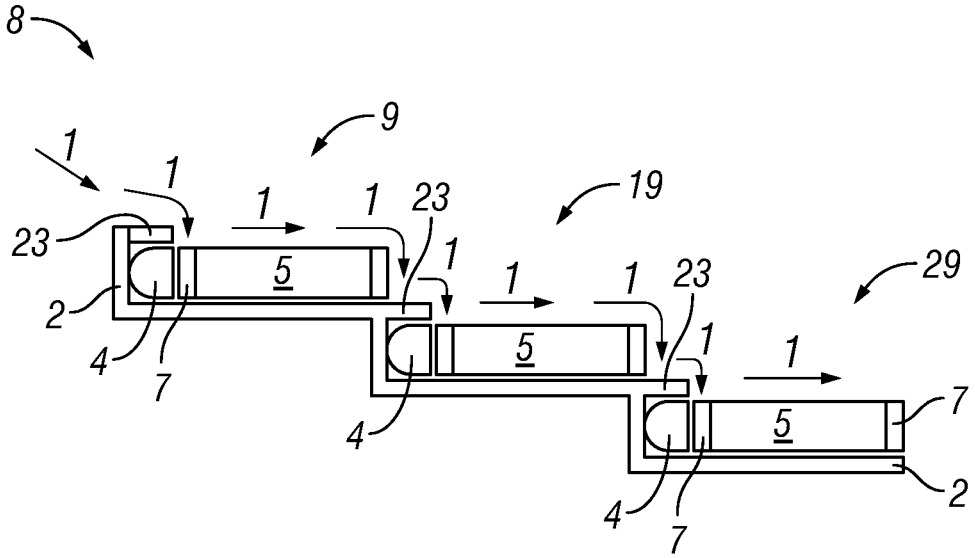
FIG. 4 is a schematic representation of another non-limiting embodiment of the present invention, showing stair stepped deck having screens 5, 15 and 25, in which the end seals 4 are protected by frame 2 in a manner that will protect end seals 4 from the direct flow of fluids/solids, and with processing flow represented by arrows 1.

Referring now to FIG. 4, there is shown a schematic representation of another embodiment of the present invention, showing stair-stepped deck having screen assemblies 9, 19 and 29. In this embodiment, screen end seals 4 are not protected from the discharge by being positioned under the previous screen assembly, but rather by the presence of a discharge shield 23 which intercepts the discharge. As shown, the screen assemblies include a screen 5 with each screen surrounded by a frame 7, and having an end seal 4 abutted/connected to the frame 7. As shown, the end seals 4 are protected from discharge falling down from the previous screen assembly by discharge shield 23 in a manner that will protect end seals 4 from the direct flow of fluids/solids, and with processing flow represented by arrows 1. Frame 2 forms a C-channel into which end seals 4 are crushed. In the embodiment as shown in FIG. 4, discharge shield 23 is formed from a portion of deck frame 2, but certainly, any type of discharge shield 23 may be utilized to protect end seals 4 from being struck by the discharge, and this discharge shield 23 may or may not be part of deck frame 2. For example, it could be independent of deck frame 2 and perhaps supported by basket 12, or supported by frame 7. The discharge shields are positioned to cause the discharge to land on the screen assembly in a landing zone that is "downstream" of the seal. As with the embodiment as described in FIG. 3, this embodiment too encompasses N number of screens.

The present invention is believed to work best if all of the discharge avoids landing/discharging on the seal. However, embodiments of the present invention include those in which at least a portion of, preferable more than a quarter of, more preferable most of (50%+), even more preferably the vast majority of (75%+), still more preferably a super majority of (90%), yet more preferably substantially all of (95%+), and yet more preferable all of (99.9%+), the discharge lands downstream of and avoids landing/discharging on the seal (with the condition being met if it is by at least one of by weight percent or by volume percent).

It should be understood that the present invention is providing improved screen arrangements and improvements to protect the seals utilized with the shaker screens, improved discharge methods to protect the seals, improved methods of operation a shale shaker and to improved methods of processing drilling fluids utilizing the apparatus of the present invention. It is believed that other details of a shale shaker, its operation and general methods of processing drilling fluids, beyond what is discussed herein that might be needed to understand the present invention, are well known to those of skill in the art and/or may be obtained from any of the prior art that is cited herein and herein incorporated by reference.

It should be understood that while the embodiments as shown in FIGS. 3 and 4 illustrate the screens as relatively horizontal, it is anticipated that in other embodiments of the present invention one or of these screens to be angled upward relative to the direction of flow to provide more residence and create more hydrostatic head for better separation on the screens.

It should also be understood that while the embodiments as shown in FIGS. 3 and 4 illustrate employment of three screens, the present invention is not to be so limited and may include any number of 2 or more screens.

More generically, as a non-limiting embodiment, there is provided a screen assemblies, deck arrangements and shale shaker as follows. The shale shaker may include a base; a basket supported by the base; a vibrator interconnected with the basket; and, N number of shaker screen assemblies releasably mounted to the basket. N will generally be greater than 1 and may be 2, 3, 4, 5, 6, 7, 8, 9, 10, 15, 20 or more. Common commercial embodiments are envisioned in which N is 2, 3, 4, 5 or 6, but certainly, the invention is not to be so limited. I will range from 1 to (N−1), with the Ith shaker screen assembly having an Ith discharge end, with the (I+1)th shaker screen assembly having an (I+1)th receiving end with an (I+1)th seal abutted thereto, with the (I+1)th screen assembly positioned such that the (I+1)th seal is positioned below the Ith shaker screen assembly, and positioned so that discharge from the Ith screen assembly will not discharge onto the (I+1)th seal. In further embodiment of this embodiments, the shale shaker of claim 1, further including wherein the (I+1)th shaker screen assembly further includes an (I+1)th screen and an (I+1)th frame surrounding the (I+1)th screen, with the (I+1)th seal abutted to the screen, and wherein the (I+1)th screen assembly is positioned such that at least a portion of the discharge from the Ith first assembly will discharge onto the frame of the (I+1)th assembly.

It should be understood that the general idea is that discharge from a prior screen assembly is onto the next screen assembly downstream of the seal and then flowing downstream across and off of that next screen assembly without contacting the seal.

It should also be understood that while the embodiments as shown in FIGS. 3 and 4 illustrate employment of one multi-screen deck 8, the present invention is not to be so limited and may include any number of one or more decks, with these multiple decks arranges in any configuration relative to each other.

It should be understood that the screens 5, 15 and 25 in the figures are shown schematically without defined screen cloth openings. It is within the scope of this invention to use any mesh or cloth, or any combination thereof, on any screen, including but not limited to, a coarser mesh on upstream screen(s) and a finer mesh on the downstream screen(s).

It should be understood that while the present invention has been illustrated mainly by reference to processing a drilling fluid, it finds utility in the processing of any sort of solids containing liquid.

All of the patents, publications, applications, articles, books, magazines, and any other prior art cited in this specification, are herein incorporated by reference.

The present disclosure is to be taken as illustrative rather than as limiting the scope or nature of the claims below. Numerous modifications and variations will become apparent to those skilled in the art after studying the disclosure, including use of equivalent functional and/or structural substitutes for elements described herein, use of equivalent functional couplings for couplings described herein, and/or use of equivalent functional actions for actions described herein. Any insubstantial variations are to be considered within the scope of the claims below.

The invention claimed is:

1. A shale shaker comprising:

a base;

a basket supported by the base;

a vibrator interconnected with the basket; and, first and second shaker screen assemblies releasably mounted to the basket by a deck frame, the deck frame including a discharge shield and a channel, the discharge shield forming at least a portion of the channel, with the first shaker screen assembly having a first discharge end, with the second shaker screen assembly having a receiving end with a seal abutted thereto, with the discharge shield located between an end of the first discharge end of the first shaker screen assembly and an end of the receiving end of the second shaker screen assembly, with the second shaker screen assembly positioned such that the seal is positioned below the first shaker screen assembly and the discharge shield and within the channel, and positioned so that discharge from the first shaker screen assembly will not discharge onto the seal.

2. The shale shaker of claim 1, wherein the second shaker screen assembly further includes a screen and a frame surrounding the screen, with the seal abutted to the screen, and wherein the second screen assembly is positioned such that at least a portion of the discharge from the first assembly will discharge onto the frame of the second assembly.

3. The shale shaker of claim 1, wherein the channel is defined in the deck frame below the first shaker screen assembly.

4. The shale shaker of claim 1, wherein the channel comprises a C-channel.

5. The shale shaker of claim 4, wherein the first discharge end of the first shaker screen assembly is aligned with an end of the channel.

6. The shale shaker of claim 5, wherein the end of the channel separates the first discharge end of the first shaker screen assembly from the seal.

7. The shale shaker of claim 5, wherein the second shaker screen assembly includes a screen and a frame surrounding the screen, and wherein the screen is positioned outside of the channel.

8. The shale shaker of claim 4, wherein the first discharge end of the first shaker screen assembly is spaced from an end of the channel.

9. The shale shaker of claim 1, wherein all of the seal is positioned within the channel.

10. The shale shaker of claim 1, wherein the first and second shaker screen assemblies are angled upward relative to a direction of flow within the shale shaker.

* * * * *